United States Patent [19]

Mitsuya et al.

[11] Patent Number: 4,782,362

[45] Date of Patent: Nov. 1, 1988

[54] RECORDING APPARATUS HAVING A FLASH FUSING APPARATUS

[75] Inventors: Teruaki Mitsuya, Hitachi; Takao Kumasaka, Takahagi; Masaru Higaki, Katsuta; Shigetaka Fujiware, Yokohama, all of Japan

[73] Assignees: Hitachi, Ltd.; Hitachi Koki Co., Ltd., both of Tokyo, Japan

[21] Appl. No.: 117,557

[22] Filed: Nov. 6, 1987

[30] Foreign Application Priority Data

Nov. 12, 1986 [JP] Japan ..... 61-267635
Mar. 31, 1987 [JP] Japan ..... 62-75799

[51] Int. Cl.[4] ..... G03G 15/20
[52] U.S. Cl. ..... 355/14 FU; 355/3 FU
[58] Field of Search ..... 355/3 FU, 3 R, 14 FU; 219/216

[56] References Cited

U.S. PATENT DOCUMENTS 4,542,980 9/1985 Tajima ..... 355/3 FU X
4,609,279 9/1986 Hausmann et al. ..... 355/3 FU X
4,668,073 5/1987 Hatabe et al. ..... 355/3 FU

FOREIGN PATENT DOCUMENTS 86429 of 1977 Japan .

*Primary Examiner*—A. C. Prescott
*Attorney, Agent, or Firm*—Antonelli, Terry & Wands

[57] ABSTRACT

The timing signal generated by the paper sending-out roller or the paper detector outputs a signal with synchronously the paper sending-out cycle. The flash lamp photoflashes with synchronously the output signal. The photoflash is generated in accordance with length of carrying direction of the paper. The paper sending-out roller sends out one of a plurality of the papers in accordance with a predetermined timing signal, and the flash lamp photoflashes at a predetermined number of times and stops the flashlight at a predetermined time in accordance with the predetermined timing signal as an index. The paper detector is installed at a position close to the paper carrying apparatus line from the flash fusing apparatus, and a delay circuit is provided so as to delay the detection output of the paper detector with a predetermined time. No photoflash irradiates the gap between a precede paper and a next paper at the continue printing the a plurality of cut sheets.

17 Claims, 5 Drawing Sheets

RECORDING APPARATUS HAVING A FLASH FUSING APPARATUS

BACKGROUND OF THE INVENTION 1. (Field of the Invention)

The present invention relates to a recording apparatus having a flash fusing apparatus and more particularly to a recording apparatus having a flash fusing apparatus wherein the toner is heated and fused on the recording paper by means of the flashlight. The flash fusing apparatus is applied for use in the recording apparatus such as the laser beam printers and the facsimile equipment etc. wherein the image is recorded on the recording paper by the toner. The fusing toner image can be obtained efficiently utilizing cut sheets having a predetermined length for the recording paper through the flash fusing apparatus.

2. (Description of the Prior Art)

A conventional flash fusing apparatus is applied for use in the recording apparatus such as the laser beam printers and the facsimile equipment etc.. In such a flash fusing apparatus in the recording apparatus, the toner is attached on the recording paper by the electrostatic energy for development process, and in fusing process the toner is heated and fused on the recording paper by photoflash of the xenon flash lamp etc. so as to form the image on the recording paper by the toner.

It is desirable to supply efficiently the fusing energy on the fusing portion of the flash fusing apparatus when the cut sheet is used as the recording paper in the recording apparatus, the gap is found inevitably between a precede recording paper and a next recording paper. Namely, no recording paper area portion exists as the gap on the recording paper carrying apparatus.

When the cut sheet is used as the recording paper and the flashlight by the xenon flash lamp irradiates with synchronously the carrying velocity of the recording paper as same as the printing with the continuous recording paper, the fusing energy by the flash fusing apparatus is supplied on the gap, then the recording paper carrying apparatus of the recording apparatus is heated. Thereby, the recording paper may be deformed, in the worse case the danger of ignition accompany also. Further there are various inconvenient problems such as waste of electric power so as to supply to unnecessary fusing energy on the gap.

A conventional recording apparatus is disclosed in, for example Japanese Utility Model Laid-Open No. 86429/1977, in which it is possible to print utilizing a cut sheet as a recording paper. In such a recording apparatus, a detector for detecting the recording paper is disposed at a recording paper carrying apparatus which is positioned at just under the fusing portion of the flash fusing apparatus. The recording paper detector comprises a photodiode and detects the fact that the recording paper reaches at just under the fusing portion of the flash fusing apparatus.

According to the detection signal by the recording paper detector, the flashlight starts by the xenon flash lamp, and then the fusing energy is supplied when the recording paper is positioned at just under the fusing portion of the flash fusing apparatus.

In the conventional recording apparatus, because that the light intensity of the flashlight of the xenon flash lamp is strong extremely, even if the recording paper exists between the recording paper detector and the xenon flash lamp, the recording paper detector may make an error in the motion. Therefore, the life time of the recording paper detector is shortened, the recording paper detector may easy to break.

For prevent the above mentioned inconvenience of the recording apparatus shown in Japanese Utility Model Laid-Open No. 86429/1977, a shutter mechanism is provided so as to cover the recording paper detector during the flashlight irradiation of the xenon flash lamp. However, when the shutter mechanism is used in the recording apparatus, it requires the shutter mechanism having high light shielding function because that the light intensity of the flashlight is strong.

SUMMARY OF THE INVENTION

An object of the present invention is to provide a recording apparatus having a flash fusing apparatus wherein a plurality of cut sheets can be fused continuously.

Another object of the present invention is to provide a recording apparatus having a flash fusing apparatus wherein no flashlight of the flash lamp irradiates between a precede recording paper and a next recording paper.

A further object of the present invention is to provide a recording apparatus having a flash fusing apparatus wherein the deformation of the recording paper can be prevented for heating the recording paper carrying apparatus.

A still object of the present invention is to provide a recording apparatus having a flash fusing apparatus wherein the photoflash timing of the flashlight can be detected securely.

A further more object of the present invention is to provide a recording apparatus having a flash fusing apparatus wherein the motion in error or the damage of the recording paper detector can be prevented.

A still more object of the present invention is to provide a recording apparatus having a flash fusing apparatus wherein the troubles such as misshot in flashlight or no ability in photoflash can be gotten of.

In accordance with the present invention, at the continue printing with a plurality of cut sheets, the timing signal source of the recording paper sending-out means or the recording paper detecting means outputs a signal with synchronously the recording paper sending-out cycle. The flash lamp photoflashes with synchronously the output signal. The photoflash is generated in accordance with length of carrying direction of the recording paper. Thereby, no photoflash irradiates the gap between a precede recording paper and a next recording paper.

In accordance of the present invention, a recording apparatus having a flash fusing apparatus comprises a recording paper holding means for holding a plurality of recording papers, the recording paper being cut down at a predetermined length, a recording paper sending-out means for sending out one of a plurality of the recording papers, a recording paper carrying means for carrying a selected recording paper at a predetermined velocity, and a flash lamp members for photoflashing at a predetermined number of times and for fusing a toner members on the selected recording paper.

The recording paper sending-out means sends out one of a plurality of the recording papers in accordance with a predetermined timing signal, and the flash lamp members photoflashes at a predetermined number of times and stops the flashlight at a predetermined time in accordance with the predetermined timing signal as an index.

The recording paper sending-out means sends out one of a plurality of the recording papers in accordance with a first timing signal, the flash lamp members photoflashes at a predetermined number of times and stops the flashlight at a predetermined time in accordance with a second timing signal, and a delay circuit members generates the second timing signal by delaying the first timing signal in accordance with a carrying time for the selected recording paper via the recording paper carrying means from the recording paper holding means to the flash lamp members.

The flash lamp members photoflashes at a predetermined number of times and stops the flashlight at a predetermined time in accordance with the detection signal of the recording paper detecting means as an index.

The recording paper detecting means outputs a first timing signal, the flash lamp members photoflashes at a predetermined number of times and stops the flashlight at a predetermined time in accordance with a second timing signal, and a delay circuit members generates the second timing signal by delaying the first timing signal in accordance with a carrying time for the recording paper via the recording paper carrying means from the recording paper detecting means to the flash lamp members.

The recording paper sending-out means sends out one of a plurality of the recording papers in accordance with a data received a predetermined timing signal and a recording paper size inputting means, and the flash lamp members photoflashes at a predetermined number of times and stops the flashlight at a predetermined time in accordance with a date received the predetermined timing signal and the recording paper size inputting means as an index.

The recording paper sending-out means sends out one of a plurality of the recording papers in accordance with a data received a first timing signal and a recording paper size inputting means, the flash lamp members photoflashes at a predetermined number of times and stops the flashlight at a predetermined time in accordance with the date received a second timing signal and the recording paper size inputting means as an index, and a delay circuit members generates the second timing signal by delaying the first timing signal in accordance with a carrying time for the selected recording paper via the recording paper carrying means from the recording paper holding means to the flash lamp members.

The recording paper detecting means is installed at a position close to the recording paper carrying apparatus line from the flash fusing apparatus, and a delay means is provided so as to delay the detection output of the recording paper detecting means with a predetermined time, the predetermined time is a carrying time of the recording paper from the recording paper detecting means to the flash fusing apparatus.

The recording paper detecting means is installed at a position close to the recording paper carrying apparatus line from the flash fusing apparatus, a delay means is provided so as to delay the detection output of the recording paper detecting means with a predetermined time, the predetermined time is a carrying time of the recording paper from the recording paper detecting means to the flash fusing apparatus, and an inhibiting means inhibits one of a detection function and an output function of the recording paper detecting means during the flash lamp members photoflashes.

According to the present invention, when the printing is practised continuously with a plurality of cut sheets, so the flashlight irradiation is not carried out between a precede recording paper and a next recording paper, there is no waste of electric power and the recording paper can be prevented from deforming by heat of the recording paper carrying apparatus.

According to the present invention, so the flashlight of the flash lamp does not irradiate directly to the recording paper detector, no shutter mechanism is required and the motion in error or the damage of the recording paper detector can be prevented.

Furthermore, during the flashlight occurrence of the flash lamp, so the detection function or the output function of the recording paper detector is inhibited, the motion in error by detection in error can be prevented.

DESCRIPTION OF THE PRESENT INVENTION

Several embodiments of the present invention will be explained with referring to drawings.

Embodiment 1

Figure 1:
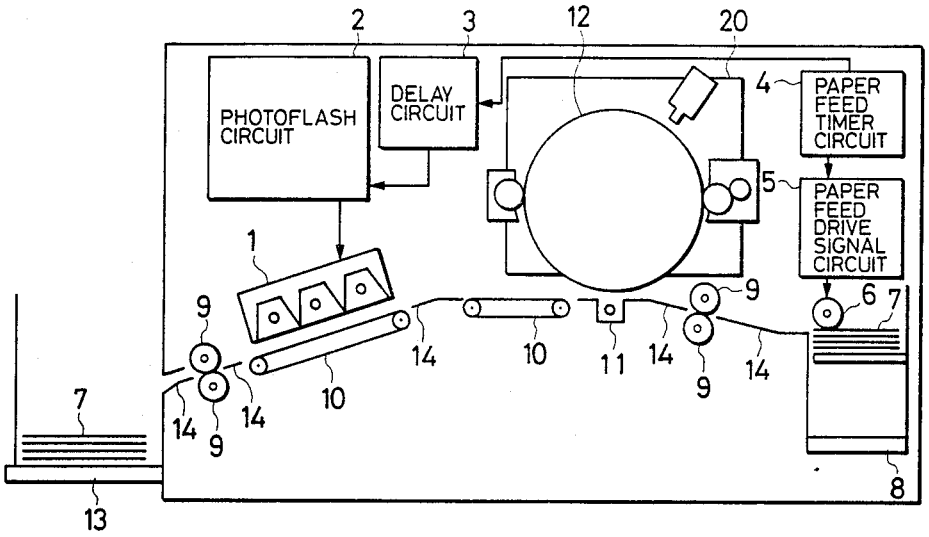
FIG. 1 is a cross-sectional side view of a recording apparatus having a flash fusing apparatus according to one embodiment of the present invention.

FIG. 1 is a cross-sectional side view of a recording apparatus having a flash fusing apparatus according to one embodiment of the present invention. The recording apparatus includes a flash fusing apparatus 1, a photoflash electric circuit 2, a delay electric circuit 3, a recording paper feed timer electric circuit 4, a recording paper feed driving signal electric circuit 5, a recording paper sending-out roller 6, a recording paper 7 as a cut sheet which has been cut down with a predetermined length in advance and a recording paper sending-out tray means 8 as a recording paper holding means. The recording apparatus includes a recording paper carrying roller 9, a recording paper carrying tractor 10, a transferring apparatus 11, a photosensitive drum 12, a recording paper stacking tray means 13 and a recording paper carrying course 14.

A recording paper sending-out means comprises the recording paper feed time timer electric circuit 4, the recording paper feed driving signal electric circuit 5 and the recording paper sending-out roller 6. A recording paper carrying means comprises the recording paper sending roller 9 and the recording paper carrying course 14. The photosensitive drum 12 is disposed within a printing unit 20.

Figure 2:
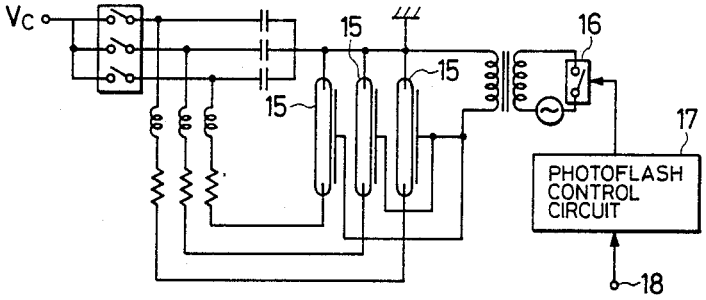
FIG. 2 is a photoflash electric circuit according to one embodiment of the present invention.
Figure 3:
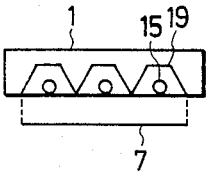
FIG. 3 is a cross-sectional side view of the flash fusing apparatus of the present invention.

FIG. 2 shows the photoflash electric circuit 2. The photoflash electric circuit 2 includes a xenon flash lamp 15, a photoflash triger signal generating switch 16, a photoflash controlling electric circuit 17 and an input terminal members 18. FIG. 3 shows a cross-sectional view of the flash fusing apparatus 1. The flash fusing apparatus 1 comprises a lamp house, the xenon flash lamp 15 disposed in the lamp house, and a reflecting plate members 19 surrounding the upper portion of the xenon flash lamp 15.

Figure 4:
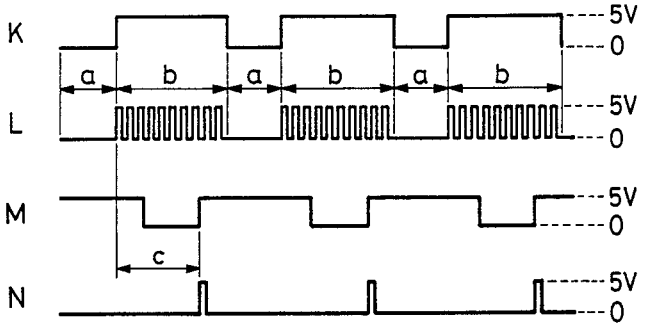
FIG. 4 shows output waveforms of various electric circuits of the present invention when the printing utilizing the recording paper having size of A4 is applied.

FIG. 4 shows output signals of various electric circuits. K is an output signal of the recording paper feed timer electric circuit 4, L is an output signal of the recording paper feed driving signal electric circuit 5, M is an output signal of the delay electric circuit 3, and N is an output signal of the photoflash controlling electric signal 17, respectively. In FIG. 4, a is a stop time of the recording paper sending-out roller 6, b is a rotation time of the recording paper feeding roller 6 and c is a delay time of the delay electric circuit 3.

In FIG. 1, the recording paper 7 is loaded on the recording paper carrying course 14, which is positioned at the nearest portion toward the recording paper sendingout tray means 8, by the recording paper sending-out roller 6, and after is carried at a constant carrying velocity by the recording paper carrying roller 9, another recording paper carrying course 14 and the recording paper carrying tractor 10.

During the carrying of the recording paper 7, a toner is developed on the recording paper 7 by the transferring apparatus 11 as a non-fused image. The recording paper 7 reaches at the installation position of the flash fusing apparatus 1, and then the xenon flash lamp 15 photoflashes a predetermined number of times, for example one time, thereby the toner is heated and fused at the fusing position of the flash fusing apparatus 1 on the recording paper 7. Thereafter the recording paper 7 is stacked in the recording paper stacking tray means 13.

In this embodiment of the present invention, the recording paper 7 is employed with size of A4 and has length of 8.5 inches at the carrying direction of the recording paper 7. The recording apparatus of this embodiment of the present invention has a continuous printing model utilizing the cut sheet. The recording paper sending-out roller 6 works repeatedly the following motion.

Namely, the recording paper sending-out roller 6 rotates until one sheet of the recording paper 7 is loaded on the recording paper carrying course 14 and stops the rotation during a constant time, and after rotates again for loading one sheet of the next recording paper 7 onto the recording paper carrying course 14. However, the recording paper carrying roller 9 and the recording paper carrying tractor 10 continue to rotate at a constant velocity.

In this embodiment of the present invention, the gap between a precede recording paper and a next recording paper is formed positively by the stop motion of the recording paper sending-out roller 6 at the continue printing with a plurality of cut sheets.

The repeating rotation by the recording paper sending-out roller 6 is carried out by a pulse motor and controls the rotation through a driving signal which is outputted by the recording paper feed driving signal electric circuit 5. A signal, which is a base one of the signal for the recording paper feed driving signal electric circuit 5, is a square waveform having a constant periodic times being outputted from the recording paper feed timer electric circuit 4.

A timing signal generated by the rotation or the stop of the recording paper sending-out roller 6 outputs a signal with synchronously the recording paper sending-out cycle.

The recording paper 7 is carried at a predetermined velocity, for example a constant carrying velocity. As to one sheet of the recording paper 7, a time from the moment of the start of the rotation of the recording paper sending-out roller 6 for loading the recording paper 7 on the recording paper carrying course 14 to the moment of the arrival of the recording paper 7 at the xenon flash lamp 15 of the fusing portion of the flush fusing apparatus 1 is a constant value.

When the output signal of the recording paper feed time electric circuit 4 plays a role as a first timing signal, the delay electric circuit 3 is inputted with the delay of the above time. The output of the delay electric circuit 3 plays a role as a second timing signal. The output of the delay electric circuit 3 inputs the photoflash controlling electric circuit 17 of the photoflash electric circuit 2 through the input terminal members 18.

Accordingly, as shown in FIG. 3, only when the recording paper 7 reaches at just under the xenon flash lamp 15, then the xenon flash lamp 15 photoflashes. The photoflash triger signal generating switch 16 closes when the signal of +5V from the photoflash controlling electric circuit 17 is inputted, and then the xenon flash lamp 15 photoflashes simultaneously with three xenon flash lamps 15. The above described various output signals are shown in FIG. 4.

As shown in FIG. 3, the coverage of fusing portion of the flash fusing apparatus 1 is length of such as 8.5 inches by adjusting the reflecting plate members 19 and is consistent of length of the recording paper 7 having size of A4.

According to the photoflash process of the above described embodiment of the present invention, no flashlight by the xenon flash lamp 15 irradiates to the gap on the recording paper carrying apparatus between a precede recording paper 7 and a next recording paper 7. Even if the flashlight by the xenon flash lamp 15 irradiates to the gap, the weak light can not reach to a necessary energy value for fusing. Therefore, the recording paper carrying tractor 10 is not heated, it has effects of no waste of electric power.

In this embodiment of the present invention shown in FIG. 1, three xenon flash lamps 15 are used in the flash fusing apparatus 1, however one xenon flash lamp may be used therein with three times of the photoflashes. There is no limitation about the number of times of the xenon flash lamp as long as the flashlight by the xenon flash lamp irradiates entirely over the recording paper.

Embodiment 2

Figure 5:
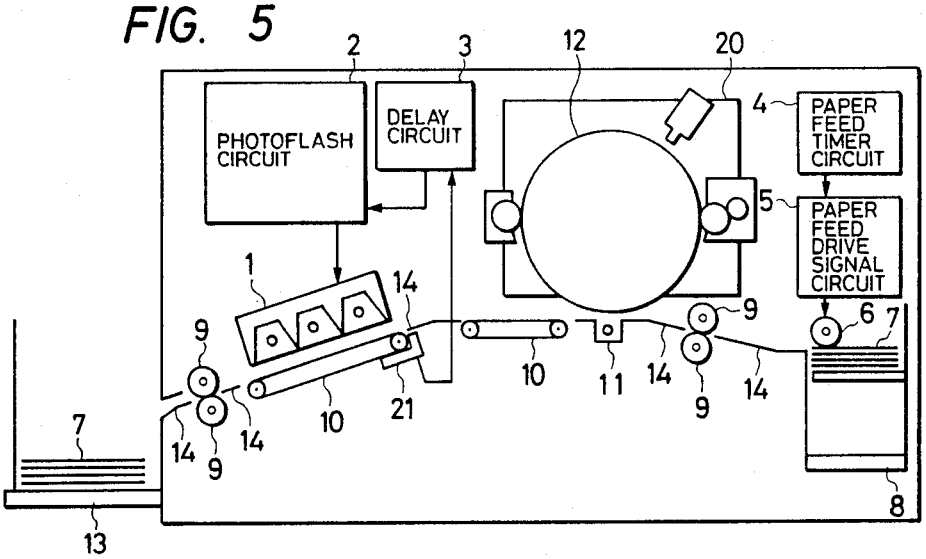
FIG. 5 is a cross-sectional side view of a recording apparatus having a flash fusing apparatus according to another embodiment of the present invention.

FIG. 5 is a cross-sectional side view of a recording apparatus having a flash fusing apparatus according to another embodiment of the present invention. A detector 21 for detecting the recording paper 7 is provided on the recording paper carrying course 14 as a detecting means for detecting the recording paper 7. The recording paper detector 21 is installed at an under portion of the recording paper carrying course 14 which is positioned at just under the nearest portion toward the flash fusing apparatus 1.

The recording paper detector 21 outputs a signal through a photosensor. When the recording paper 7 is situated on the recording paper detector 21, the signal is outputted at a high level (for example, +5V). When the recording paper 7 is not situated on the recording paper detector 21, the signal is outputted at a low level (for example, 0V).

The output of the recording paper detector 21 becomes same output of the recording paper feed timer electric circuit 4 with a time delay. In this embodiment of the present invention, the output of the recording paper feed timer electric circuit 4 does not input into the delay electric circuit 3, the output of the recording paper detector 21 serves as to be a first timing signal and is inputted. Other structures except the recording paper dectector 21 of this embodiment shown in FIG. 5 of the present invention are same as that of the former embodiment shown in FIG. 1 of the present invention.

In this embodiment of the present invention, after the recording paper 7 passes the installation position of the recording paper detector 21, the recording paper 7 arrives at just under the flash fusing apparatus 1. The delay time of the delay electric circuit 3 is set to be a passing time. The passing time is defined as a transferring time of the recording paper 7 from the installation position of the recording paper detector 21 to the installation position of the flash fusing apparatus 1.

Therefore, in this embodiment of the present invention, the flashlight by the xenon flash lamp 15 is irradiated only on the recording paper 7 as same as the former embodiment shown in FIG. 1 of the present invention.

In the former embodiment, the delay electric circuit 3 is inputted by the output of the recording paper feed timer electric circuit 4. In such a case, it comes into question in the recording apparatus such as no arrival of the recording paper 7 at the installation position of the flash fusing apparatus 1, nevertheless the xenon flash lamp 15 photoflashes.

However, according to this embodiment of the present invention, the output of the recording paper detector 21 is inputted to the delay electric circuit 3. The xenon flash lamp 15 does not photoflash unless the recording paper 7 arrives at the installation position of the recording paper detector 21, therefore when the above mentioned troubles such as the jam of the recording paper occur before the recording paper 7 arrives the recording paper detector 21, the irradiation of the flashlight by the xenon flash lamp 15 stops automatically.

Embodiment 3

Next, another embodiment of the present invention will be explain in which it is possible to print the recording paper having size of A4 and A3. In this embodiment of the present invention, a change-over switch for selecting the recording paper having size of A3 is provided in the recording apparatus. The operator can select the size of the recording paper 7 by the selection of the change-over switch. Other structures except for the change-over switch of this embodiment is same as the structures of the embodiment shown in FIG. 1.

The gap between a precede recording paper and a next recording paper is a constant value in the printing of the recording paper having size of A3 or in the printing of the recording paper having size of A4. The width of the gap of this embodiment is same as that of the former embodiment shown in FIG. 1.

When the recording paper having size of A3 is used, the length of the recording paper 7 at the carrying direction has 17 inches twice as long as the recording paper having size of A4. Therefore, under the printing of the recording paper having size of A3, the time ($b_1$) of the square waveform, which is the basis for the rotation time of the recording paper sending-out roller 6 in accordance with the output of the recording paper feed timer electric circuit 4, is set to be twice as long as the recording paper having size of A4.

The output signal of the photoflash controlling electric circuit 17 is set so as to photoflash two times. Namely, the xenon flash lamp 15 photoflashes one time during the transfer of the recording paper 7 at the flash fusing apparatus 1 as same as under the printing of the recording paper having size of A4, and after photoflashes at one time after the carrying of the recording paper 7 at carrying length of 8.5 inches.

Figure 6:
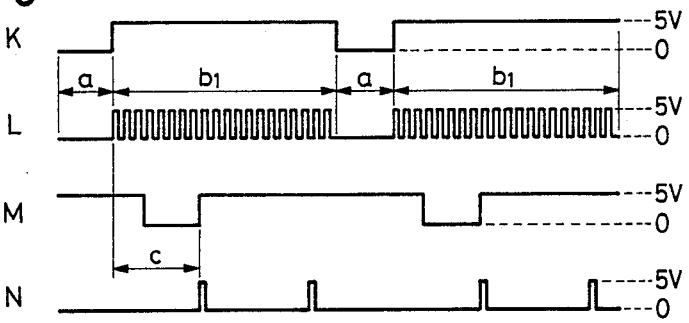
FIG. 6 shows output waveforms of various electric circuits of the present invention when the printing utilizing the recording paper having size of A3 is applied.

According to this embodiment of the present invention, the recording paper feed timer electric circuit 4 and the photoflash controlling electric circuit 17 have two kinds of output waveforms. When the operator indicates a printing mode of the recording paper having size of A4, the output waveforms of the recording paper feed timer electric circuit 4 and the photoflash controlling electric circuit 17 become that of shown in FIG. 4. When the operator indicates a printing mode of the recording paper having size of A3, the output waveforms of the recording paper feed timer electric circuit 4 and the photoflash controlling electric circuit 17 become that of shown in FIG. 6, respectively.

According to this embodiment of the present invention, the printing can be practised with the recording paper having size of A4 and the recording paper having size of A3. When the recording paper feed timer electric circuit 4 and the photoflash controlling electric circuit 17 are used and further the recording apparatus shown in FIG. 5 is adapted, it is possible to print with both of the recording paper having size of A4 and A3. When the trouble such as the jam of the recording paper occurs before the recording paper 7 arrives at the installation position of the recording paper detector 21, the irradiation of the photoflash by the xenon flash lamp 15 stops automatically.

Embodiment 4

Figure 7:
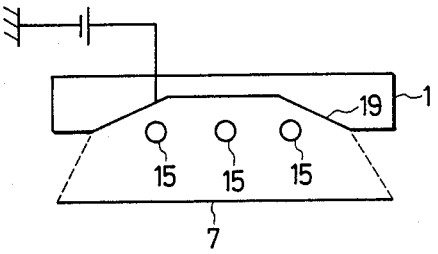
FIG. 7 is a cross-sectional side view of the flash fusing apparatus when the recording paper having size of A3 is applied.
Figure 8:
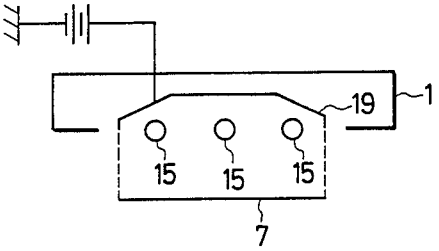
FIG. 8. is a cross-sectional side view of the flash fusing apparatus when the recording paper having size of A4 is applied.

Another embodiment of the flash fusing apparatus in the recording apparatus will be explained with referring to drawings. FIG. 7 shows the flash fusing apparatus 1 when the printing of the recording paper having size of A3 is carried out. FIG. 8 shows the flash fusing apparatus 1 when the printing of the recording paper having size of A4 is carried out.

The shape of the reflecting plate members 19 of the flash fusing apparatus 1 varies in accordance with the application of voltage with the reflecting plate members 19. The fusing coverage by the reflecting plate members 19 becomes following. When the structure of the reflecting plate 19 shown in FIG. 7 is adopted, the fusing coverage is set at 17 inches, and when the structure of the reflecting plate members 19 shown in FIG. 8 is adopted, the fusing coverage is set at 8.5 inches.

According to this embodiment of the present invention, as the reflecting plate members 19 is made of the material in which the shape of the reflecting plate members 19 varies, it is possible to fuse at one time by the photoflash on the recording paper having size of A3 as well as the recording paper having size of A4. Further, an output mode of the photoflash controlling electric circuit 17 is over done with one mode.

Embodiment 5

Another embodiment of the present invention will be explained with referring to FIGS. 9, 10 and 11. The recording apparatus further includes a detecting means 31 for detecting the recording paper 7, a pilot lamp 32 and a light shielding plate members 33 installed with the flash fusing apparatus 1.

A curvature portion 40 is provided between the flash fusing apparatus 1 and the printing unit 20. The curvature portion 40 comprises a right horizontal portion **40*a* and a left inclined portion 40*b*. The left inclined portion 40*b* has a left downward slope shape form. The recording paper carrying tractor 10 includes a plurality of belts 34 for carrying the recording paper 7 and further provides a plurality of holes 35 for attracting the recording paper 7 and a hole 36 for intaking the light for the recording paper detector 31**.

The recording paper attracting holes 35 is provided on the recording paper carrying tractor 10 except for the installation portion of the recording paper carrying belts 34. According to intake air via the recording paper attracting holes 35, the recording paper 7 is attracted to an upper surface of the recording paper carrying belts 34 and carried with the stick condition.

The light intake hole 36 is provided so as to intake the light from the pilot lamp 32 toward the recording paper detector 31. The light shielding plate members 33 is provided for shielding the flashlight from the flash fusing apparatus 1. The light shielding plate members 33 prevents the flashlight from irradiating toward the photosensitive drum 12. The curvature portion 40 is provided at the midway of the transferring apparatus 11 and the flash fusing apparatus 1.

In the fusing system utilizing the xenon flash lamp 15, the printing unit 20 provides a light shielding cover members **20*a* at outer wall portion thereof so as to prevent the light fatigue by the irradiation of the leak light of the flashlight. However, in the light shielding cover members 20*a* alone, it is impossible to prevent the irradiation of the leak light from the flash fusing apparatus 1 at the transfer position of the photosensitive drum 12. Therefore, it is necessary to bent the recording paper carrying apparatus between the transferring apparatus 11 and the flash fusing apparatus 1**.

The curvature portion **40*a* of this embodiment of the present invention is provided according to the above mentioned reasons. The curvature portion 40** may have a shape form such as bent (fold down) shape and a shape form having a curvature.

The recording paper detector 31 comprises a photodiode and a reverse circuit for reversing the signal of the photodiode. The recording paper detector 31 is installed on the recording paper carrying side from just under the flash fusing apparatus 1, in other words at an upstream of the recording paper carrying course 14.

According to this embodiment of the present invention, the recording paper detector 31 is installed at the internal portion of the recording paper carrying tractor 10, which is provided between the curvature portion 40 and the transferring apparatus 11.

Figure 11:
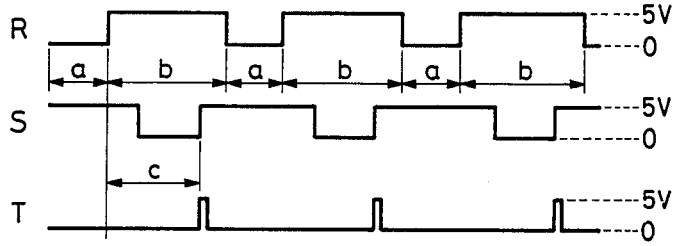
FIG. 11 shows output waveforms of various electric circuits according to a further embodiment of the present invention.

FIG. 11 shows output signals of various electric circuits. R indicates an output signal of the recording paper detector 31, S indicates an output signal of the delay electric circuit 3, and T indicates an output signal of the photoflash electric circuit 2, respectively. In the output signal R, a is a time in which the recording paper 7 is not situated on an upper portion of the recording paper detector 31, and b is a time in which the recording paper 7 is situated on the upper portion of the recording paper detector 31. In the output signal S, c is a delay time of the delay electric circuit 3.

According to this embodiment of the present invention, the light from the pilot lamp 32 is shielded during the recording paper 7 covers over the light intake hole 36, so that the recording paper 7 outputs the high level voltage, for example +5 V, as shown in the waveform R. The output signal K applies to the delay electric circuit 3.

In the delay electric circuit 3, a front end of one sheet of the recording paper 7 covers over the light intake hole 36 and the delay electric circuit 3 outputs at +5 V in the recording paper detector 31. After that the delay electric circuit 3 delays the output of the recording paper detector 31 as much a time (the delay time (c) shown in FIG. 11) which is one from the moment of covering the light intake hole 36 to the moment of reaching the front end of the fusing portion of the flash fusing apparatus 1.

In this embodiment of the present invention of the recording apparatus, it is assumed that the carrying velocity of the recording paper 7 was a constant. Therefore, the delay time (c) is set in advance. The distance between the installation position of the recording paper detector 31 and the front end of fusing portion of the flash fusing apparatus 1 is maintained as a constant value.

Therefore, even if the carrying velocity of the recording paper 7 changes over, the delay time (c) is calculated according to the change over of the carrying velocity of the recording paper 7. Thus, it is possible to set easily the delay time (c) according to the change over of the carrying velocity the recording paper 7.

The photoflash electric circuit 2 is adopted the same structure shown in FIG. 2. The output signal S of the delay electric circuit 3 applies to the input terminal members 18 of the photoflash controlling electric circuit 17 in the photoflash electric circuit 2, a spike signal of +5 V (waveform T shown in FIG. 11) is outputted with synchronously the rising of the outputted square waveform of +5 V.

This output signal T inputs to the switch 16 for generating the photoflash triger signal and then the photoflash triger signal generating switch 16 closes. After the triger signal for photoflashing with synchronously the xenon flash lamp 15 generates, the photoflash triger signal generating switch 16 opens automatically. Thereby, three xenon flash lamps 15 photoflash with synchronously according to the photoflash electric circuit 2.

When the xenon flash lamp 15 photoflashes, as the delay time (c) has been past, the front end of the recording paper 7 has arrived at the front end of the fusing portion of the flash fusing apparatus 1. Thus, the recording paper 7 is position at just under the flash fusing apparatus 1 with an alignment state. The fusing coverage of the flash fusing apparatus 1 is set to be equal to the length of carrying direction of the recording paper 7. With the above mentioned a series of motions, the toner is fused securely on the recording paper 7.

In this embodiment of the present invention, the recording paper detector 31 is installed at the downstream side of the recording paper carrying side from the curvature portion 40, within the limits of the upstream side of the recording paper carrying side from just under the flash fusing apparatus 1. At this arrangement position of the recording paper detector 31, the direct light of the flashlight by the xenon flash lamp 15 is not irradiated on the recording paper detector 31 but also the leak light of the flashlight by the xenon flash lamp 15 is shielded by the curvature portion 40, therefore the light strength toward the recording paper detector 31 is lowered remarkably.

According to this embodiment of the present invention, no direct light of the photoflash by the xenon flash lamp 15 irradiates toward the recording paper detector 31. As the leak light strength of the flashlight by the xenon flash lamp 15 is lowered, no damage of the recording paper detector 31 and no error in motion (the error in detection of the recording paper 7 etc.) cause, and the life time of the recording paper detector 31 can be lengthen.

According to this embodiment of the present invention, as the recording paper 7 covers over the recording paper detector 31, as long as the light which reaches the recording paper detector 31 from the pilot lamp 32 via the light intake hole 36 is shielded, the xenon flash lamp 15 does not photoflash. Thereby, when the jam of the recording paper causes at the upstream side from the recording paper detector 31, the flash fusing apparatus 1 stops automatically the photoflash.

When the scattering of the carrying interval of the recording paper 7 occurs as a result of trouble happened at the recording paper sending-out roller 6 etc., the photoflash of the flash fusing apparatus 1 is synchronously with a real arrival of the recording paper 7. Therefore the flash fusing apparatus 1 photoflashes automatically according to the scattering of the carrying interval of the recording paper 7 and the toner can be fused securely on the recording paper 7.

Embodiment 6

Figure 12:
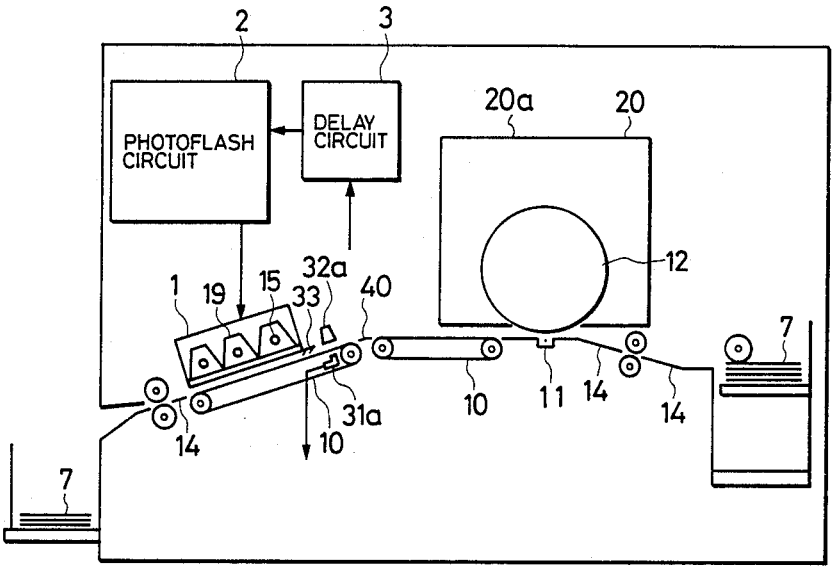
FIG. 12 is a cross-sectional side view of a recording apparatus having a flash fusing apparatus according to a still embodiment of the present invention.
Figure 13:
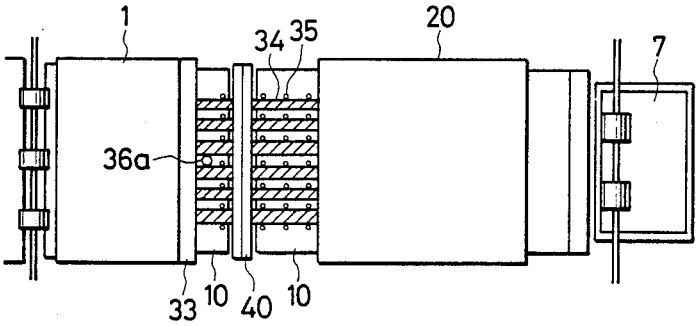
FIG. 13 is a plan view of a recording apparatus having a flash fusing apparatus shown in FIG. 12.

A further embodiment of the present invention will be explained with referring to FIGS. 12, 13 and 14. This embodiment of the present invention is modified the embodiment shown in FIGS. 9, 10 and 11.

Figure 9:
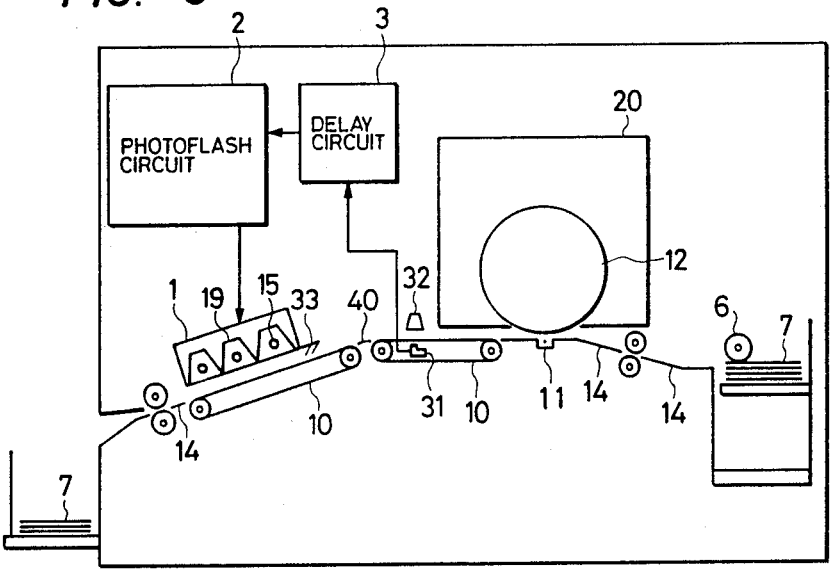
FIG. 9 is a cross-sectional side view of a recording apparatus having a flash fusing apparatus according to a further embodiment of the present invention.
Figure 10:
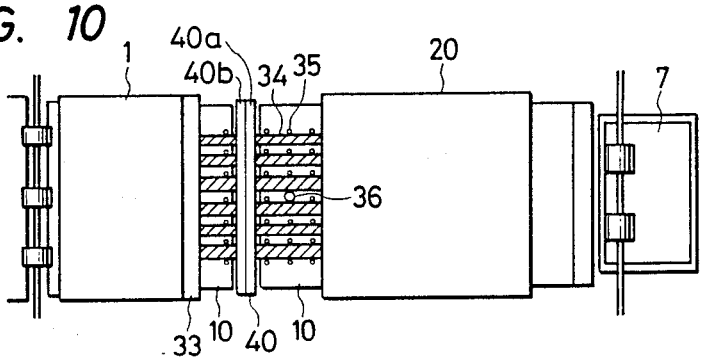
FIG. 10 is a plan view of a recording apparatus having a flash fusing apparatus shown in FIG. 9.

As is evident from contrast with FIG. 9, in this embodiment of the present invention, a pilot lamp **32*a*, a light intake hole 36*a* and a recording paper detector 31*a* are provided respectively at the downstream side of the recording paper carrying course 14 in comparison with the structures shown in FIGS. 9 and 10. The pilot lamp 32*a*, the light intake hole 36*a* and the recording paper detector 31*a* are installed respectively between the curvature portion 40 of the recording paper carrying course 14 and the light shielding plate members 33 of the flash fusing apparatus 1**.

The photoflash electric circuit 2 is same as that of shown in FIG. 2, and the position relationship of between the flash fusing apparatus 1 and the recording paper 7 during the flashlight irradiation is same as that of the embodiment shown in FIGS. 9 and 10.

Figure 14:
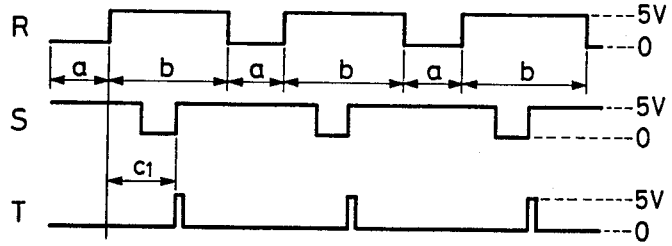
FIG. 14 shows output waveforms of various electric circuits according to another embodiment of the present invention.

FIG. 14 shows output signals of various electric circuits. The time relationship on the output signal R of the recording paper detector **31*a* is same as that of shown in FIG. 11. However, as a time between the moment of covering the light intake hole 36*a* by the recording paper 7 and the moment of reaching the recording paper 7 at just under the fusing portion of the flash fusing apparatus 1 is shorten than that of the embodiment shown in FIGS. 9, 10 and 11, the delay time ($c_1$) of the delay electric circuit 3 in this embodiment is shorter than the delay time (c) of the embodiment shown in FIG. 11**.

In the recording apparatus, the jam of the recording paper occurs largely at the position in which the carrying direction of the recording paper 7 is varied. In this embodiment shown in FIG. 12, the occurrence probability of the jam of the recording paper is high at the surrounding area of the curvature portion 40, particularly the jam of the recording paper occurs easily when the front end of the recording paper 7 is situated at the inside of the surrounding area of the curvature portion 40. At the area from the above mentioned surrounding area of the curvature portion 40 to the fusing position just under the flash fusing apparatus 1, the jam of the recording paper 7 hardly occurs because of no existence of the curvature portion on the recording paper carrying apparatus.

According to this embodiment of the present invention, so the recording paper 7 is positioned at the upstream side from just under the flash fusing apparatus 1 and is detected at the downstream side of the flash fusing apparatus 1 from the area which is high occurrence probability area, no motion in error and no damage of the recording paper detector **31*a* occur by the direct flashlight. The occurrence of the flashlight by the xenon flash lamp 15** according to the jam of the recording paper generated in the recording apparatus can be stop automatically.

Similar to the embodiment shown in FIGS. 9, 10 and 11, according to this embodiment of present invention, when the scattering of the carrying interval of the recording paper 7 occurs, the flash fusing apparatus 1 can fuse the toner with a sure and accurate timing according to the scattering of the carrying interval.

Embodiment 7

Figure 15:
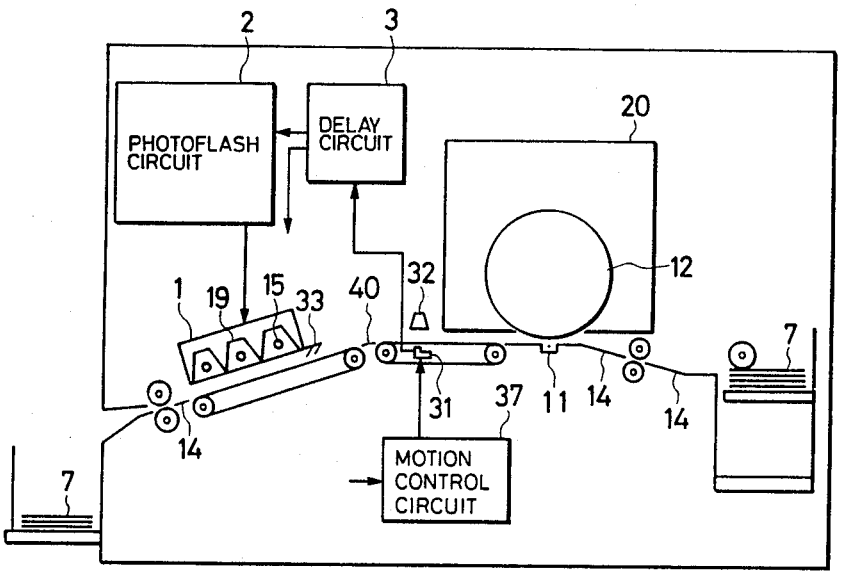
FIG. 15 is a cross-sectional side view of a recording apparatus having a flash fusing apparatus according to a still further embodiment of the present invention.

A still embodiment of the present invention will be explained with referring to FIGS. 15 and 16. The recording apparatus of this embodiment shown in FIG. 15 is modified that of the embodiment shown in FIGS. 9 and 10. In FIG. 15, a motion controlling electric circuit 37 is provided so as to control the motion of the recording paper detector 31.

In this embodiment of the present invention, the output of the delay electric circuit 3 applies to the photoflash controlling electric circuit 17 and further applies to the motion controlling electric circuit 37 of the recording paper detector 31 as a feedback signal.

Figure 16:
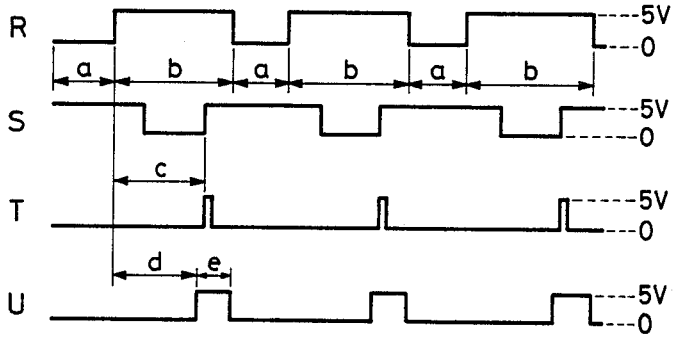
FIG. 16 shows output waveforms of various electric circuits according to a still further embodiment of the present invention.

The delay electric circuit 3 inputs the square waveform of +5 V to the photoflash electric circuit 2 so as to determine the photoflash timing of the xenon flash lamp 15, as shown in the square waveform T in FIG. 16.

In this embodiment of the present invention, the square waveform U of +5 V outputs to the motion controlling electric circuit 37 as a feedback signal. The square waveform U rises early at a predetermined time (for example, 1 ms) from the output signal T, in other words the square waveform U has a delay time (d) which is shorter than the delay time (c) of the square waveform T.

When the motion controlling electric circuit 37 receives the square waveform of +5 V (feedback signal) from the delay electric circuit 3, the detection function or the output function of the recording paper detector 31 are caused to stop during a predetermined time (e) (for example 5 ms) from the rising time of the square waveform. Namely, as shown in the square waveform U in FIG. 16, the recording paper detector 31 is made its detection motion or its output generation to inhibit during the predetermined time (e) from passing the delay time (d) which is shorter than the delay time (c).

The predetermined time (e) of the square waveform U is set to lengthen the flashlight generating time of the xenon flash lamp 15. Therefore, the output of the recording paper detector 31 becomes to be 0 V at the least during the flashlight generation of the xenon flash lamp 15.

The recording paper detector 31 is installed at a position in which following relationship formula is applicable.

$$L=n(L_1+L_2)-\tfrac{1}{2}L_2$$

wherein L is a distance along the recording paper carrying apparatus line from the recording paper detector 31 to the front end at the carrying portion of the recording paper 7 (the front end of the fusing portion) being situated just under the flash fusing apparatus 1 when the flashlight by the xenon flash lamp 15 photoflashes, $L_1$ is length at the carrying direction of the recording paper 7, $L_2$ is a gap between a precede recording paper and a next recording paper during the carrying of the recording paper 7, and n is an integer. The integer n is preferable under the integer 5.

As is evident from the above relationship formula, when the xenon flash lamp 15 photoflashes the flashlight, it means that no recording paper 7 is situated at the detection position of the recording paper detector 31.

When each circuit constant of the photoflash electric circuit 2 and the motion controlling electric circuit 37 is set suitably, so long as if the output inhibiting motion of the recording paper detector 31 assumed that such a motion was not delay from the flashlight rising of the xenon flash lamp 15, the feedback signal may substitute of the output signal S.

According to this embodiment of the present invention, when the xenon flash lamp 15 photoflashes the flashlight, the detection function or the output function of the recording paper detector 31 is stopped so that the output maintains at 0 V. Thereby, when the recording paper detector having high sensitive detection ability is used, the recording paper detector prevents the detection of the leak light of the flashlight and the output of the detection signal in error.

When the flashlight by the xenon flash lamp 15 is photoflashed, no recording paper is situated at the installation position of the recording paper detector 31, so that the stop of the detection function or the output function of the recording paper detector 31 do not affect in any way on the detection ability of the recording paper detector 31.

We claim:

1. A recording apparatus having a flash fusing apparatus comprising: a recording paper holding means for holding a plurality of recording papers, the recording paper being cut down at a predetermined length; a recording paper sending-out means for sending out one of a plurality of the recording papers; a recording paper carrying means for carrying a selected recording paper at a predetermined velocity; and a flash lamp members for photoflashing at a predetermined number of times and for fusing a toner members on said selected recording paper, characterized in that said recording paper sending-out means sends out one of a plurality of the recording papers in accordance with a predetermined timing signal, and said flash lamp members photoflashes at a predetermined number of times and stops the flashlight at a predetermined time in accordance with said predetermined timing signal as an index.

2. A recording apparatus having a flash fusing apparatus comprising: a recording paper holding means for holding a plurality of recording papers, the recording paper being cut down at a predetermined length; a recording paper sending-out means for sending out one of a plurality of the recording papers; a recording paper carrying means for carrying a selected recording paper at a predetermined velocity; and a flash lamp members for photoflashing at a predetermined number of times and for fusing a toner members on said selected recording paper, characterized in that said recording paper sending-out means sends out one of a plurality of the recording papers in accordance with a first timing signal, said flash lamp members photoflashes at a predetermined number of times and stops the flashlight at a predetermined time in accordance with a second timing signal, and a delay circuit members generates said second timing signal by delaying said first timing signal in accordance with a carrying time for said selected recording paper via said recording paper carrying means from said recording paper holding means to said flash lamp members.

3. A recording apparatus having a flash fusing apparatus comprising: a recording paper carrying means for carrying recording papers at a predetermined velocity, the recording paper being cut down at a predetermined length; a recording paper detecting means for outputting a detection signal in accordance with presence of the recording paper being sent at a predetermined velocity; and a flash lamp members for photoflashing at a predetermined number of times and for fusing a toner members on said selected recording paper, characterized in that said flash lamp members photoflashes at a predetermined number of times and stops the flashlight at a predetermined time in accordance with said detection signal of said recording paper detecting means as an index.

4. A recording apparatus having a flash fusing apparatus comprising: a recording paper carrying means for carrying recording papers at a predetermined velocity, the recording paper being cut down at a predetermined length; a recording paper detecting means for detecting presence of the recording paper being carried at a predetermined velocity; and a flash lamp members for photoflashing at a predetermined number of times and for fusing a toner members on the recording paper, characterized in that said recording paper detecting means outputs a first timing signal, said flash lamp members photoflashes at a predetermined number of times and stops the flashlight at a predetermined time in accordance with a second timing signal, and a delay circuit members generates said second timing signal by delaying said first timing signal in accordance with a carrying time for the recording paper via said recording paper carrying means from said recording paper detecting means to said flash lamp members.

5. A recording apparatus having a flash fusing apparatus comprising: a recording paper holding means for holding a plurality of recording papers, the recording paper being cut down at a predetermined and different length; a recording paper size inputting means for inputting length of the recording paper; a recording paper sending-out means for sending out one of a plurality of the recording papers; a recording paper carrying means for carrying a selected recording paper at a predetermined velocity; and a flash lamp members for photoflashing at a predetermined number of times and for fusing a toner members on said selected recording paper, characterized in that said recording paper sending-out means sends out one of a plurality of the recording papers in accordance with a data received a predetermined timing signal and said recording paper size inputting means, and said flash lamp members photoflashes at a predetermined number of times and stops the flashlight at a predetermined time in accordance with said date received said predetermined timing signal and said recording paper size inputting means as an index.

6. A recording apparatus having a flash fusing apparatus comprising: a recording paper holding means for holding a plurality of recording papers, the recording paper being cut down at a predetermined and different length; a recording paper size inputting means for inputting length of the recording paper; a recording paper sending-out means for sending out one of a plurality of the recording papers; a recording paper carrying means for carrying a selected recording paper at a predetermined velocity; and a flash lamp members for photoflashing at a predetermined number of times and for fusing a toner members on said selected recording paper, characterized in that said recording paper sending-out means sends out one of a plurality of the recording papers in accordance with a data received a first timing signal and said recording paper size inputting means, said flash lamp members photoflashes at a predetermined number of times and stops the flashlight at a predetermined time in accordance with said date received a second timing signal and said recording paper size inputting means as an index, and a delay circuit members generates said second timing signal by delaying said first timing signal in accordance with a carrying time for said selected recording paper via said recording paper carrying means from said recording paper holding means to said flash lamp members.

7. A recording apparatus having a flash fusing apparatus according to claims 1 to 6, characterized in that said predetermined velocity of said recording paper carrying means is substantially constant.

8. A recording apparatus having a flash fusing apparatus according to claims 1 to 6, characterized in that said predetermined number of times of said flash lamp members is determined in accordance with length of a carrying direction of the recording paper.

9. A recording apparatus having a flash fusing apparatus according to claim 1, characterized in that said flash lamp members photoflashes with synchronously said predetermined timing signal at a predetermined number of times and fuses said toner members on said selected recording paper.

10. A recording apparatus having a flash fusing apparatus according to claim 5, characterized in that said flash lamp members photoflashes with synchronously said predetermined timing signal at a predetermined number of times in accordance with said data received from said recording paper size inputting means and fuses said toner members on said selected recording paper.

11. A recording apparatus having a flash fusing apparatus according to claim 6, characterized in that said flash lamp members photoflashes with synchronously said second timing signal at a predetermined number of times in accordance with said data received from said recording paper size inputting means and fuses said toner members on said selected recording paper.

12. A recording apparatus having a flash fusing apparatus comprising: a recording paper sending-out means; a toner image forming means for forming a toner image on a recording paper being carried from said recording paper sending-out means; a flash fusing apparatus including a flash lamp members and for fusing the toner image on the recording paper by irradiating flashlight from said flash lamp members; a recording paper carrying means for carrying the recording paper along a predetermined carrying apparatus line from said toner image forming means to said flash fusing apparatus; a recording paper detecting means provided on said recording paper carrying apparatus; and a flash lamp photoflashing means for photoflashing said flash lamp members in accordance with a detection output of said recording paper detecting means, characterized in that said recording paper detecting means is installed at a position close to said recording paper carrying apparatus line from said flash fusing apparatus, and a delay means is provided so as to delay said detection output of said recording paper detecting means with a predetermined time, said predetermined time is a carrying time of the recording paper from said recording paper detecting means to said flash fusing apparatus.

13. A recording apparatus having a flash fusing apparatus according to claim 12, characterized in that said recording paper carrying apparatus includes a curvature portion being provided between said toner image forming means and said flash fusing apparatus, and said recording paper detecting means is installed between said curvature portion and said flash fusing apparatus.

14. A recording apparatus having a flash fusing apparatus according to claim 12, characterized in that the recording paper is a cut sheet.

15. A recording apparatus having a flash fusing apparatus according to claim 12, characterized in that said flash fusing apparatus includes a light shielding members so as to prevent flashlight of said flash lamp members from irradiating on said recording paper detecting means.

16. A recording apparatus having a flash fusing apparatus comprising: a recording paper sending-out means; a toner image forming means for forming a toner image on a recording paper being carried from said recording paper sending-out means; a flash fusing apparatus including a flash lamp members and for fusing the toner image on the recording paper by irradiating flashlight from said flash lamp members; a recording paper carrying means for carrying the recording paper along a predetermined carrying apparatus line from said toner image forming means to said flash fusing apparatus; a recording paper detecting means provided on said recording paper carrying apparatus; and a flash lamp photoflashing means for photoflashing said flash lamp members in accordance with a detection output of said recording paper detecting means, characterized in that said recording paper detecting means is installed at a position close to said recording paper carrying apparatus line from said flash fusing apparatus, a delay means is provided so as to delay said detection output of said recording paper detecting means with a predetermined time, said predetermined time is a carrying time of the recording paper from said recording paper detecting means to said flash fusing apparatus, and an inhibiting means inhibits one of a detection function and an output function of said recording paper detecting means during said flash lamp members photoflashes.

17. A recording apparatus having a flash fusing apparatus according to claim 16, characterized in that said recording paper detecting means is installed at a position in which a following relationship formula is applicable, $$L=n\,(L_1+L_2)-\tfrac{1}{2}L_2$$

wherein L is a distance along said recording paper carrying apparatus line from said recording paper detecting means to a front end at a carrying direction of the recording paper being situated just under said flash fusing apparatus when flashlight is photoflashed, $L_1$ is length at the carrying direction of the recording paper, $L_2$ is a gap between a precede recording paper and a next recording paper during the carrying of the recording paper, and n is an integer.

* * * * *